US010093453B1

(12) United States Patent
Taylor

(10) Patent No.: US 10,093,453 B1
(45) Date of Patent: Oct. 9, 2018

(54) CLUSTERED HANGING BASKETS ARRAY

(71) Applicant: Robert Lee Taylor, Oakland, CA (US)

(72) Inventor: Robert Lee Taylor, Oakland, CA (US)

( * ) Notice: Subject to any disclaimer, the term of this patent is extended or adjusted under 35 U.S.C. 154(b) by 0 days.

(21) Appl. No.: 14/998,416

(22) Filed: Jan. 4, 2016

(51) Int. Cl.
*B65D 1/38* (2006.01)
*B65D 25/22* (2006.01)

(52) U.S. Cl.
CPC ..... *B65D 25/22* (2013.01); *B65D 1/38* (2013.01)

(58) Field of Classification Search
CPC ..... A47B 46/00; A47B 46/005; A47B 63/06; A47B 63/062; A47B 63/065; A47B 63/067; B65D 1/38; B65D 25/22; B65D 25/25
USPC ..... 220/23.83, 23.86, 23.87, 23.89; 312/247, 312/248; 248/318; 254/337, 338; 211/117; 47/67; D6/514; D11/148
See application file for complete search history.

(56) References Cited

U.S. PATENT DOCUMENTS 803,274 A * 10/1905 Deaver ..... A47F 5/0892 211/117
2,005,566 A * 6/1935 Schwabe ..... A47B 31/04 108/177
D222,949 S * 2/1972 Goddfrey ..... 47/67
3,827,376 A * 8/1974 Solomon ..... A47B 31/04 108/177
3,841,237 A * 10/1974 Plymate ..... A47B 43/00 108/179
4,032,102 A * 6/1977 Wolf ..... A47G 7/047 248/301
4,121,720 A * 10/1978 Hayes ..... A47F 5/0892 211/113
4,159,094 A * 6/1979 Stekoll ..... A47G 7/047 248/318
4,181,234 A * 1/1980 Feighan ..... A47G 7/047 211/113
4,349,172 A * 9/1982 Banks, Jr. ..... A47G 7/047 248/318
5,503,587 A * 4/1996 Mellen ..... G09B 23/10 248/318
5,595,395 A * 1/1997 Wilson ..... B62L 31/14 280/47.19
D416,409 S * 11/1999 Matthews ..... D11/148
D517,832 S * 3/2006 Jenkins ..... D6/405
7,032,347 B2 * 4/2006 Hartman ..... A47G 7/047 47/67
7,293,664 B2 * 11/2007 Belokin ..... A47F 5/0892 211/113

(Continued)

FOREIGN PATENT DOCUMENTS

GB 518498 A * 2/1940 ..... A47B 19/002

*Primary Examiner* — Joshua E Rodden

(57) ABSTRACT

An improved hanging baskets array that tilts down on one side to expose contents offers a method for clustering the baskets to maximize storage capacity within a given amount of space, while improving utility. Including a plurality of vertically mounted baskets pivotally set in a support framework made with a treble of flexible material. The plurality of clustered baskets attached to the flexible material by a number of preferred connectors can be lowered simultaneously by activation of a common cord lock and pulley mechanism joined by a chord to a support chain attached at the front of the baskets. One embodiment of the array uses a graduated series of circular baskets. A second embodiment of the array has a series of oval baskets.

4 Claims, 3 Drawing Sheets

(56) References Cited

U.S. PATENT DOCUMENTS

| | | | | |
|---|---|---|---|---|
| D630,125 | S * | 1/2011 | Vogt | D11/148 |
| 8,439,211 | B2 * | 5/2013 | Emrani | A47B 49/00 211/162 |

* cited by examiner

CLUSTERED HANGING BASKETS ARRAY

CROSS-REFERENCE TO RELATED APPLICATIONS

This is a division of application Ser. No. 61/797,318, filed 2012 Dec. 3, now abandoned.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND—PRIOR ART

The following is a tabulation of some prior art that presently appears relevant:

| | U.S. patents | | |
|---|---|---|---|
| Pat. No. | Kind Code | Issue Date | Patentee |
| D463,697 | S | Oct. 1, 2002 | Klein et al. |
| 6,464,086 | B1 | Oct. 15, 2002 | Klein et al. |
| | U.S. patent application Publication | | |
| Publication Nr. | Kind Code | Issue Date | Applicant |
| 2003/0085188 | A1 | May 8, 2003 | Klein et al. |
| 2004/0007549 | A1 | Jan. 15, 2004 | Klein et al. |

For many decades the three tiered hanging wire basket array was a staple in the kitchen for storing vegetables. It can be conveniently hung above the kitchen counter and is often hung above appliances on the counter.

A drawback with the present configuration is the difficulty in accessing the upper basket to find a particular vegetable specimen, as looking into the upper baskets is a challenge for the average sized person. When this basket array is raised higher over the counter to accommodate appliances already occupying the counter space, it becomes more challenging to access the contents for most users.

Several types of hanging units have been designed to hang on the back of doors that provide an alternative option for storing items; most recently as described in U.S. Pat. No. 6,464,086 (2002), U.S. Pat. No. D463,697 (2002), and U.S. publications 2003/0085188 (2003), 2004/0007549 (2004), all to Klein et al. The functional design of these hanging units limits their utility to doors in bathrooms and other spaces were similar products are used. Further, the utility of this arrangement is manly limited to items that stand up on their base, such as shampoo bottles and other similar items.

Thus there is a need for a hanging storage unit that securely holds disparate and oddly shaped items such as fruits and vegetables, as well as other similarly shaped items. An array of hanging baskets, which pivots open on a fulcrum axis to conveniently expose the contents for easy access will allow more storage in a given space.

In order to provide for a stable hanging storage container, the mass of each hanging basket will hang below the fulcrum axis; this provides the baskets with a low center of gravity. A basket with a substantial portion of its mass below the fulcrum axis is more stable and will readily find a new center of gravity, achieving equilibrium without dislodging the contents.

SUMMARY

A practical solution to access of hanging basket arrays is exhibited in various embodiments that add a chord lock and pulley system to one of three support members to allow one edge of all baskets to lower by gravity making their access convenient. Along with the utility of lowering the baskets to gain access, comes an opportunity to cluster more baskets in the space previously provided for accessing for the contents.

By allowing one chain to be releasable, the action of gravity is utilized to lower the sides of all the baskets for easy access simultaneously. The alternative addition of a pulley and locking mechanism provides a means for controlling the extent the baskets are lowered.

Clustering of hanging baskets linked together with a cord lock and pulley system gives the user full control of the extent of the open position of the baskets when utilized for various purposes. To obtain easy access to the contents of the baskets, without exposing all of the contents, the baskets can be conveniently locked in a partial open or tilted position, with a simple flick of the wrist; this allows full control for setting the baskets positions between closing and opening with one hand remaining free to handle potential content. If the user wishes to use the baskets for display or other such purpose the basket array may be locked in the fully tilted or open position.

In one embodiment the traditional flexible basket array with its graduated sized round baskets can be maintained for its design qualities, while uniform sized flexible baskets all can also be utilized in another embodiment.

The graduated sized round clustered basket array will maintain a single anchor for suspending the unit, along with a cord lock and pulley added for activating the motion, while the uniform size version of the clustered basket array will have a ceiling mount to carry the load at three points with one point housing a pulley and cord lock.

The summary of the embodiments above contains considerable detail; it is provided to illustrate some selected embodiments of the embodiment and should not be considered as limiting the possibility of the invention. Conceivable embodiments may also include suitable variations in the shape and materials for the baskets, the construction method, as well as the size of the structure and baskets, along with the means of portability.

BRIEF DESCRIPTION OF THE SEVERAL VIEWS OF THE DRAWING(S)

Drawings—Figures

The appended drawings illustrate the method and system of the embodiment, it will be understood that such drawings represent select embodiments of the embodiment and, therefore, are not meant to limit its possibility regarding other embodiments which the embodiment may suggest or contemplate.

Therefore:

DRAWINGS—REFERENCE NUMERALS

Figure 1A:
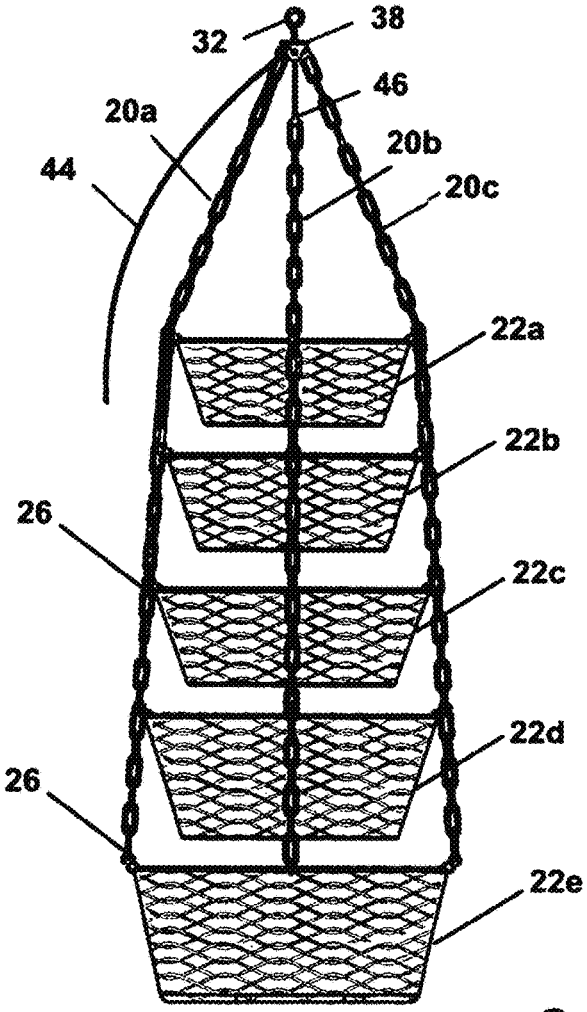
FIG. 1A is an illustration of a flexible mesh version of the embodiment following the traditional lines of graduated size baskets, with rotating hanger with cord lock and pulley array in neutral or closed position.

20. flexible vertical support structure (a,b,c)
22. flexible basket (a,b,c,d,e)
24. S-hook connector
26. ring connector
28. carabineer connector
30. swivel chain connector
32. array eye-loop hanger
34. array hanger mechanism
36. array hook hanger
38. cord lock and pulley mechanism
40. ceiling mount
42. chain
44. chord
46. chain-cord connector

DETAILED DESCRIPTION

Description of First Embodiment

Figure 1B:
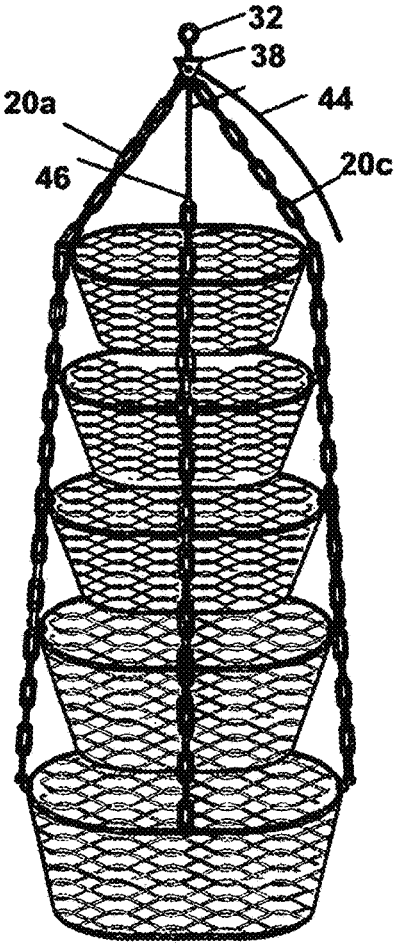
FIG. 1B is an illustration of a flexible mesh version of the embodiment following the traditional lines of graduated size baskets, with rotating hanger with cord lock and array in an open position.
Figure 1C:
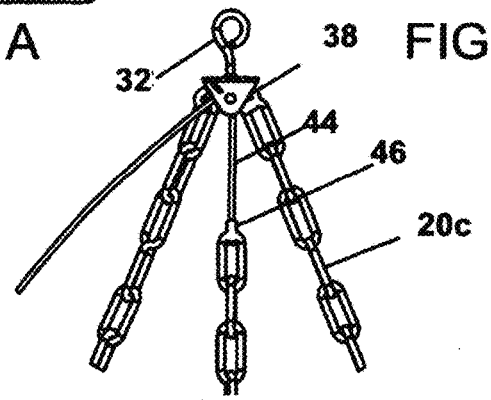
FIG. 1C is an illustration showing a cord lock and pulley array on a rotating hanger for use with the flexible mesh version of the embodiment having graduated size baskets.
Figure 2A:
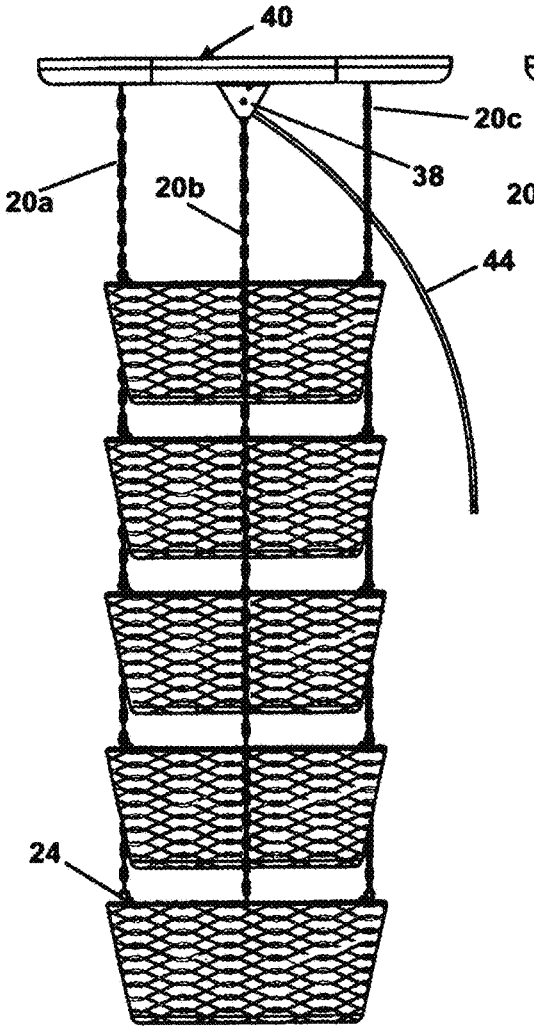
FIG. 2A is an illustration of a flexible mesh version of the embodiment with uniform baskets attached to a ceiling mount with and a cord lock and pulley array in a neutral or closed position.
Figure 2B:
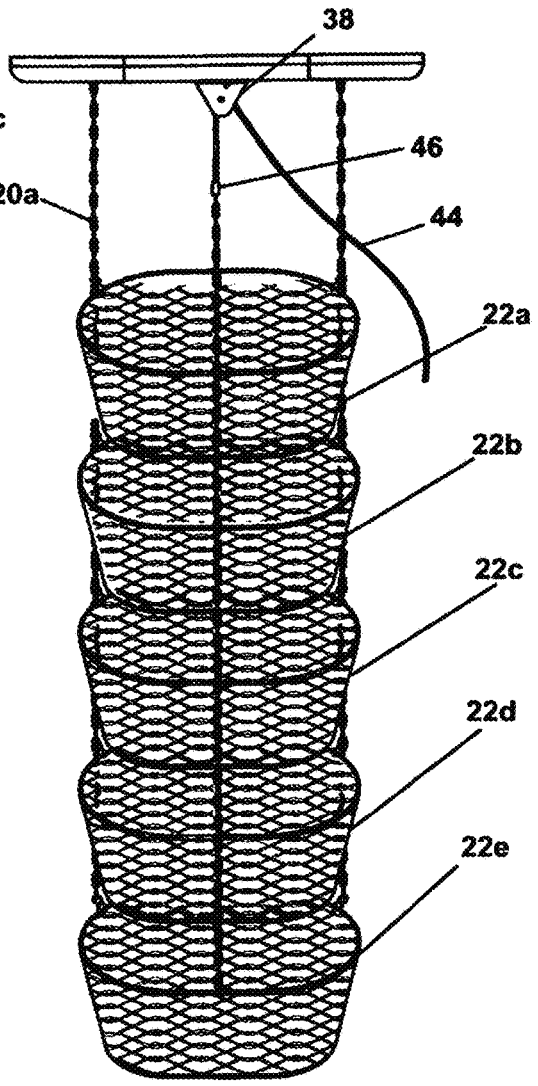
FIG. 2B is an illustration of a flexible mesh version of the embodiment with uniform baskets attached to a ceiling mount with and a cord lock and pulley array in an open position.
Figure 2C:
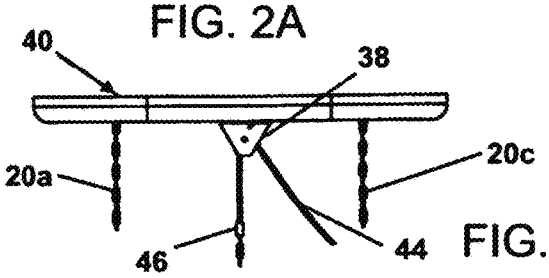
FIG. 2C is an illustration of a ceiling mount with and a cord lock and pulley array for use on the flexible mesh version of the embodiment with uniform baskets.

FIGS. 1A and 1B, as well as FIGS. 2A and 2B, depict the clustered hanging baskets array as an improvement over the traditional three-tier wire basket array. FIGS. 1A and 2A show the array in their neutral or closed position and FIGS. 1B and 2B show the array in their pivoted or open position. The baskets are common flexible mesh baskets familiar to the traditional three-tier wire basket array.

Clustering of the baskets in this embodiment is facilitated by the use of a common chord lock mechanism 38 as a method for simultaneously tilting the baskets, which allows for additional baskets in the otherwise wasted space between the baskets. The chord lock mechanism 38 is activated by a chord 44 attached to a chain 42 by a chain/cord connector 46. Chain 42 is linked to each basket in the array with an S-hook 24 separately engaged with each flexible mesh basket so as to allow them all to pivot. Flexible vertical support structure 20 a,b,c, in concert with gravity, act as a structure for supporting the baskets, with the common chord lock mechanism 38.

Figure 3:
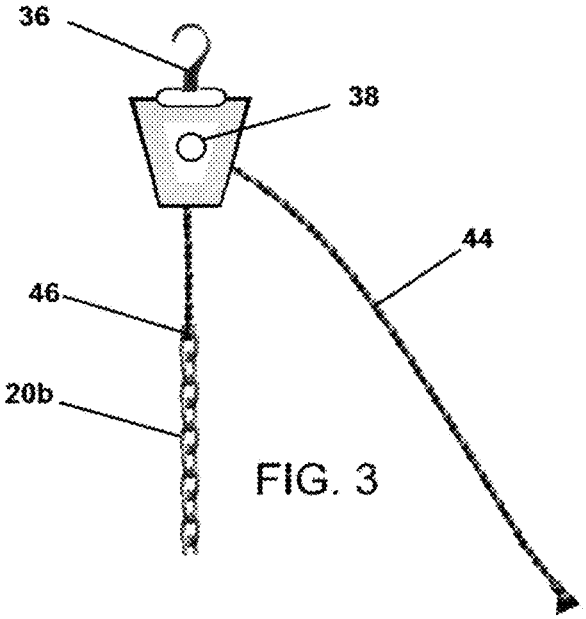
FIG. 3 is a blown up illustration of cord lock and pulley array on a rotating hanger for use with the flexible mesh version of the embodiment having graduated size baskets.
Figure 4:
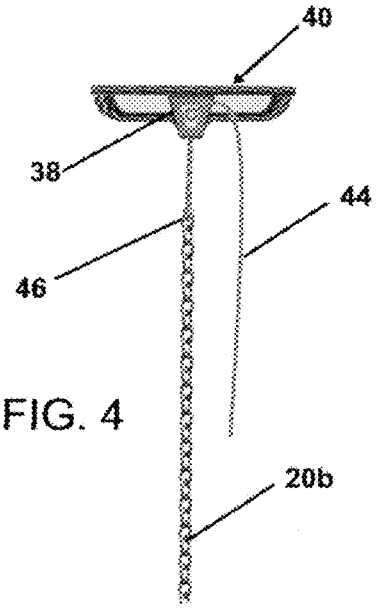
FIG. 4 is a blown up illustration of a ceiling mount with a cord lock and pulley mechanism for use on the flexible mesh version of the embodiment with uniform baskets.
Figure 5:
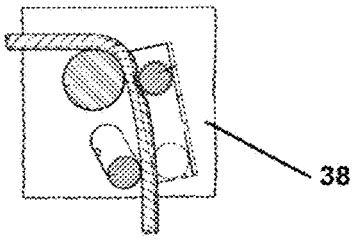
FIG. 5 is an example of a common a cord lock and pulley mechanism.
Figure 6:
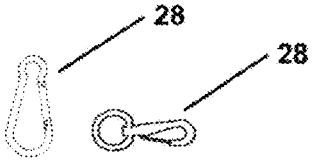
FIG. 6 is an example of carabineer connectors.
Figure 7:
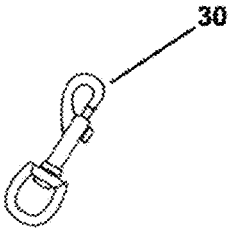
FIG. 7 is an example of a swivel chain connector.
Figure 8:
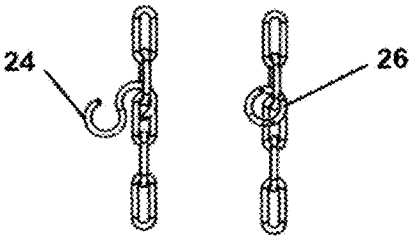
FIG. 8 is an example of the S-hook and ring connectors.

Embodiment shown in FIGS. 1A and 1B retain the graduated basket feature of the traditional wire basket array and hangs from a single free hanging eye-loop 32, with hanger rotation mechanism 34, and common chord lock mechanism 38 as seen in FIG. 5. Embodiment shown in FIGS. 2A and 2B has an array of baskets each with a significantly equivalent shape and size, which is suspended from a ceiling mount 40 that also houses the common chord lock mechanism 38 as shown in FIG. 3.

Conclusion or Ramification

Thus the reader will see that at least one embodiment of the clustered hanging baskets array provides greater utility over the prior art, with more capabilities in an equivalent space.

While the above descriptions contain much specificity, these should not be construed as limitations on the scope, but rather as an exemplification of several embodiments thereof. Many other variations are possible for example the baskets can have other shapes, such as octagonal with alternative flexible materials such as braided fabric or woven fibers. Though there are five basket containers depicted in the embodiments above, any number of baskets may be utilized in the practice of the design.

The flexible vertical support structure in the first and second embodiment can be of any bendable flexible material such as rope, cable, braided fabric, or woven fibers. Besides the S-hook or Loop connector method for connecting the baskets to the chain, the action can be accomplished by numerous other methods including but not limited to a carabineer connector 28 or swivel chain connector 30.

Accordingly, the scope should be determined not by the embodiments illustrated, but by the appended claims and their legal equivalents.

Benefits

Side of baskets release to pivot down making it easier to access contents.

More baskets hanging in a given space.

I claim:

1. A clustered hanging baskets array comprising: a plurality of flexible hanging baskets of predetermined size and material, a flexible treble vertical support framework in which to suspend said flexible hanging baskets sufficient in length to cluster a predetermined number of said flexible hanging baskets, a plurality of connectors for appending said flexible hanging baskets to the said flexible treble vertical support framework to allow for tilting of said flexible hanging baskets, a common pulley and cord lock mechanism for simultaneously controlling a degree of tilting of said flexible hanging baskets by a cord, and a housing for the said cord lock mechanism that has a hook to suspend the said flexible treble vertical support framework.

2. The array as described in claim 1, wherein the housing for said cord lock mechanism includes a mounting plate that affixes to a ceiling via the hook and suspends the said flexible treble vertical support framework, whereby the plurality of hanging baskets can be clustered together to maximize space, while allowing one side of the array to be lowered for easy access to the contents.

3. A clustered hanging baskets assembly comprising: a plurality of hanging baskets of predetermined size and material, a vertical support means for suspending said hanging baskets sufficient in length to allow for positioning said hanging baskets at a predetermined distance from each other, connector means for attaching said hanging baskets to the said vertical support means, which also provides for a motion allowing top edges of one side of all said hanging baskets to pivot downward for access, a cord lock and pulley for pivoting simultaneously said hanging baskets using a cord to provide access to ail the baskets concurrently, a ceiling mounting means for suspending the clustered hanging baskets assembly, whereby the plurality of hanging baskets can be hung close to each other, in a vertical series, to maximize space, while pivoting to allow for easy access.

4. A cord lock and pulley method for clustering hanging baskets to maximize space comprising: a framework structure carrying a plurality of hanging baskets clustered proximally to each other, said framework having connectors for attaching said hanging baskets to the framework structure which allows the said hanging baskets to each pivot on a respective fulcrum axis, said hanging baskets each having a shape wherein a bulk of its mass is below the respective fulcrum axis, said hanging baskets being engaged with a cord lock and pulley that when activated by a cord pivots all of the said hanging baskets simultaneously, said cord lock and pulley combination allows the baskets, when pivoted, to be locked and set in many desired positions, whereby the plurality of hanging baskets can be ganged close to each other in a cluster for maximizing space, while pivoting and locking to allow for easy access.

* * * * *